US011511293B2

(12) United States Patent
Zhou et al.

(10) Patent No.: US 11,511,293 B2
(45) Date of Patent: Nov. 29, 2022

(54) WATER MIST NANO GASIFICATION CONVERSION DEVICE

(71) Applicant: Zhiqiang Zhou, Guangdong (CN)

(72) Inventors: Zhiqiang Zhou, Guangdong (CN); Xiaofeng Zhang, Guangdong (CN); Guoxiong Chen, Guangdong (CN)

(73) Assignee: Zhiqiang Zhou, Guangzhou (CN)

( * ) Notice: Subject to any disclaimer, the term of this patent is extended or adjusted under 35 U.S.C. 154(b) by 429 days.

(21) Appl. No.: 16/792,797

(22) Filed: Feb. 17, 2020

(65) Prior Publication Data

US 2020/0179962 A1 Jun. 11, 2020

Related U.S. Application Data

(63) Continuation of application No. PCT/CN2017/000752, filed on Dec. 25, 2017.

(30) Foreign Application Priority Data

Aug. 18, 2017 (CN) ..... 201710710970.4

(51) Int. Cl.

| | |
|---|---|
| ***B05B 17/06*** | (2006.01) |
| ***B05B 5/025*** | (2006.01) |
| ***B05B 5/03*** | (2006.01) |
| ***B05B 5/053*** | (2006.01) |

(52) U.S. Cl.

CPC ..... *B05B 5/03* (2013.01); *B05B 5/0255* (2013.01); *B05B 5/0531* (2013.01); *B05B 5/0533* (2013.01); *B05B 17/06* (2013.01); *B05B 17/0615* (2013.01)

(58) Field of Classification Search

None

See application file for complete search history.

(56) References Cited

U.S. PATENT DOCUMENTS 3,941,312 A * 3/1976 Ohno ..... B41J 2/1606 239/102.1
5,916,640 A * 6/1999 Liu ..... B05B 17/0607 239/707
6,595,208 B1 * 7/2003 Coffee ..... B05B 5/0255 239/690

(Continued)

FOREIGN PATENT DOCUMENTS

CN 202268603 U 6/2012
CN 202835560 U 3/2013

(Continued)

*Primary Examiner* — Binu Thomas

(57) ABSTRACT

The present invention discloses a water mist nano gasification conversion device, including a main body (1), an electronic high-voltage generator (5), a water inlet (3), a water supply tank (4), an electronic water mist spraying device (6) arranged in the water supply tank (4), and an atomization tube (2) arranged above the water supply tank (4). Water droplets and water mist sprayed by the electronic water mist spraying device (6) by using a negative electric field are blown into an electric field region which is arranged in the atomization tube (2) for ionization and decomposition. The nanoscale water mist generated by the device has the advantages of sterilizing and humidifying the air, improving air cleanliness and achieving skin moisturization.

11 Claims, 2 Drawing Sheets

(56) References Cited

U.S. PATENT DOCUMENTS

| | | | | |
|---|---|---|---|---|
| 2006/0007273 | A1* | 1/2006 | Punsalan | B41J 2/085 347/76 |
| 2010/0006027 | A1* | 1/2010 | Yang | B05B 5/082 118/671 |
| 2014/0367478 | A1* | 12/2014 | Roos | B05B 5/0255 239/707 |
| 2015/0266032 | A1* | 9/2015 | Zhou | F24F 8/10 96/53 |

FOREIGN PATENT DOCUMENTS

| | | | |
|---|---|---|---|
| CN | 103225862 | A | 7/2013 |
| CN | 104180449 | A | 12/2014 |

* cited by examiner

WATER MIST NANO GASIFICATION CONVERSION DEVICE

CROSS-REFERENCE TO RELATED APPLICATIONS

This application is a continuation of International Patent Application No. PCT/CN2017/000752, filed on Dec. 25, 2017, which claims the benefit of priority from Chinese Patent Application No. 201710710970.4, filed on Aug. 18, 2017. The contents of the aforementioned application, including any intervening amendments thereto, are incorporated herein by reference in its entirety.

TECHNICAL FIELD

The present invention relates to a water mist generation technology, and particularly relates to a water mist nano gasification conversion device which can produce sterilized nanoscale water mist through conversion.

BACKGROUND OF THE PRESENT INVENTION

Three atomization devices are common on the current market, i.e., an ultrasonic atomization device, an electrothermal atomization device and a pressure spray device. The common characteristics of the three devices are large particle size of the atomized water mist, low visibility, no negative charge and weak penetrability. Due to the large particle size of the water mist generated by the above atomization devices, the water mist settles quickly and cannot freely float into the air. In this way, it is easy to cause the water mist to precipitate near the atomization devices to form water strains, and to form hanging water droplets on the surfaces of objects such as wires, electrical appliances, instruments and equipment, furniture and books, causing moisture damage to the books, the furniture and the instruments, short circuits in the conductive wires and the electrical appliances, and even fire. Moreover, the water mist with the large particle size can easily cause bacteria to breed in the surrounding environment and reduce the air quality in a room. Moreover, the humidified air is not sterilized, which is easy to induce respiratory diseases.

In addition, with the development of industry, the emission of automobile exhaust and factory exhaust produces a large amount of polluted air. The bacteria produced by people and animals spread through the air to form infectious diseases. This is the root cause that hazards physical health in real life. However, the current common air humidifiers do not have the functions of sterilization and disinfection, and cannot improve the air freshness.

SUMMARY OF THE PRESENT INVENTION

In order to solve the above technical problems, the purpose of the present invention is to provide a water mist nano gasification conversion device which has the functions of sterilization and disinfection.

The present invention adopts the following technical solution: a water mist nano gasification conversion device is provided, wherein a main body of the water mist nano gasification conversion device comprises a shell and an atomization tube; the shell is provided with a supporting element for accommodating a conductive wire and supporting a conductive rod to isolate the conductive wire and water mist; the shell is of a hollow structure; an electronic high-voltage generator, a water supply tank, and an electronic water mist spraying device arranged in the water supply tank are arranged in the shell; the atomization tube is accommodated in the main body and is located above the water supply tank; an electric field region which uses a negative electric field to ionize and decompose water droplets and water mist sprayed by the electronic water mist spraying device is arranged in the atomization tube; the electric field region comprises at least one electric field generating component; the electric field generating component comprises a conductive ring and a conductive rod; one end of the conductive rod is fixed on the supporting element, and the other end is suspended and inserted into the conductive ring; a voltage output terminal of the electronic high-voltage generator is electrically connected with the conductive rod; and a grounding terminal of the electronic high-voltage generator is electrically connected with the conductive ring.

Further, the interior of the supporting element is of a hollow structure; the conductive rod is electrically connected with the output terminal of the electronic high-voltage generator through a first conductive wire; one end of the first conductive wire is accommodated in the hollow structure of the supporting element, and is connected with the conductive rod inside the supporting element; and the other end of the first conductive wire extends out of the shell through the hollow structure in the supporting element, and then is electrically connected with the voltage output terminal of the electronic high-voltage generator.

Further, a groove for accommodating the first conductive wire is arranged on an outer wall of the shell.

Further, the conductive ring is electrically connected with the grounding terminal of the electronic high-voltage generator through a second conductive wire; and a waterproof insulation element is arranged on the second conductive wire.

Further, the atomization tube is an atomization tube made of insulation material.

Further, a high-voltage electric field generating component is composed of a conductive ring sheet component into which the conductive rod is inserted.

Further, the water mist nano gasification conversion device further comprises a water inlet which is communicated with the water supply tank.

Further, the water mist nano gasification conversion device further comprises a fan for blowing the water droplets and the water mist sprayed by the electronic water mist spraying device into the atomization tube.

Further, the negative high voltage outputted by the electronic high-voltage generator is above 2 KV.

Further, the electronic water mist spraying device comprises an ultrasonic water mist spraying device and a pressure nozzle water mist spraying device.

Further, the atomization tube is a water mist diversion device, and is a spraying tube having a square or circular cross section.

Further, the conductive ring is made of a conductive sheet.

Further, the conductive sheet is made of a conductive fiber cloth, a metal sheet, or a plastic sheet coated with a conductive layer on an outer surface.

Further, the conductive rod is a metal rod, a conductive fiber rod, or a plastic rod coated with a conductive layer on an outer surface.

Further, the spraying direction of the atomization tube includes but not limited to four directions of up, down, left and right.

The present invention has beneficial effects that: when the device of the present invention works, the electronic water mist spraying device sprays the water droplets and the water mist after processing the water in the water supply tank. The sprayed water droplets and water mist enter an electric field region in the atomization tube for ionization and decomposition of the negative electric field, then are ionized and decomposed into nanoscale charged water mist, and sprayed out from a spraying port of the atomization tube. It can be seen that the device of the present invention can generate water vapor with a nanoscale particle size, and solves the problem caused by the large particle size of water mist. Moreover, since the device of the present invention uses the negative electric field to ionize and decompose the water droplets and the water mist sprayed by the electronic water mist spraying device, the effect of sterilizing and disinfecting the water droplets and the water mist by using a high-voltage electric field in a decomposition process can be achieved. Meanwhile, the water mist contains a large amount of negative ions. The negative ions achieve the effect of cleaning the air, which can effectively adsorb and settle micro dust and bacteria in the air, and improve the cleanliness of the air. In addition, since the water mist sprayed by the device of the present invention is nanoscale negatively charged water mist, the dirt with positive electrons on the surface of human skin can be absorbed and removed. Meanwhile, nanoscale water vapor is easily absorbed by the skin to keep the skin hydrated and elastic. The conductive rod is connected by the conductive wire, and the conductive wire is not in direct contact with the water mist, so as to avoid condensation of water vapor on the conductive wire, avoid forming a high-voltage discharge circuit by copper wires in the conductive rod and the conductive wire and avoid reducing the high voltage, so that the generation efficiency of nano water ions is not affected.

BRIEF DESCRIPTION OF THE DRAWINGS

To more clearly describe the technical solutions in the embodiments of the present invention, the drawings required to be used in the description of the embodiments will be simply presented below. Apparently, the drawings in the following description are merely some embodiments of the present invention, and for those skilled in the art, other drawings can also be obtained according to these drawings without contributing creative labor.

DESCRIPTION OF MAIN ELEMENTS

Figure 1:
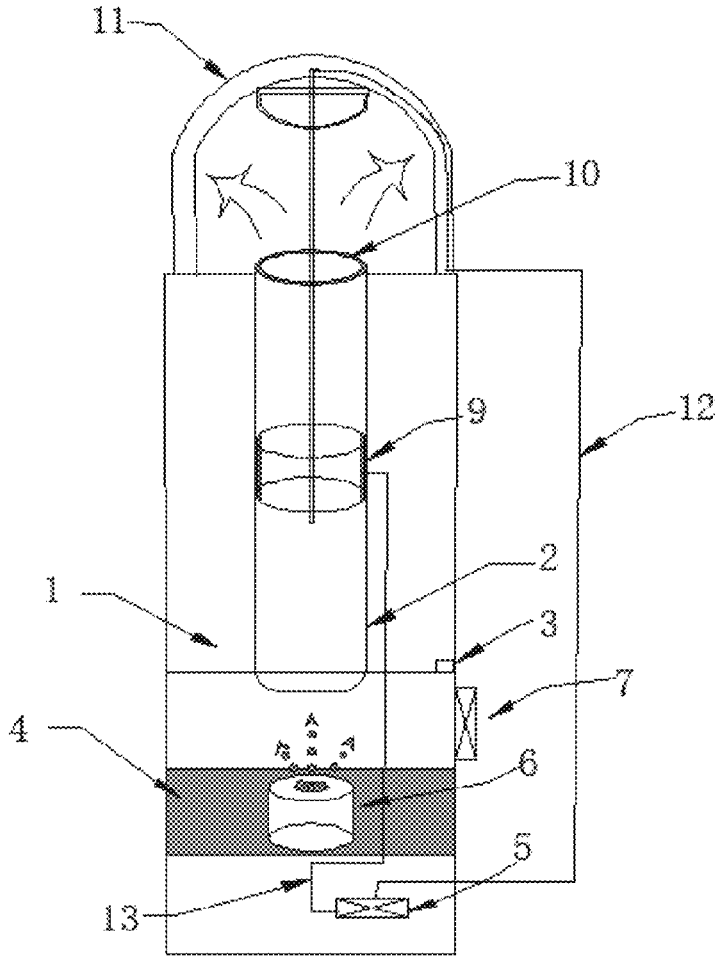
FIG. 1 is a structural schematic diagram of a water mist nano gasification conversion device in a first embodiment of the present invention.
Figure 2:
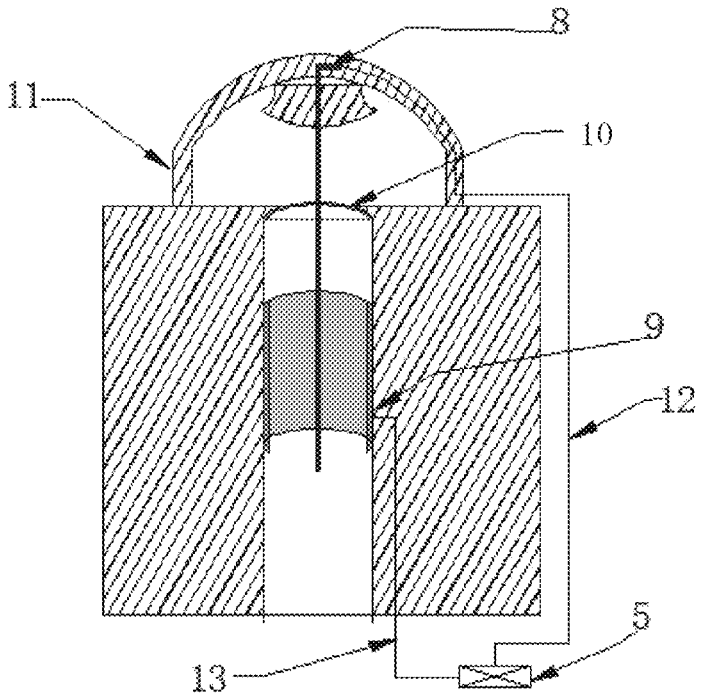
FIG. 2 is a structural enlarged schematic diagram of an atomization tube and an electric field region in a first embodiment of the present invention.

1 main body; 2 atomization tube; 3 water inlet; 4 water supply tank; 5 electronic high-voltage generator; 6 electronic water mist spraying device; 7 fan; 8 conductive rod; 9 conductive ring; 10 spraying port; 11 supporting element; 12 first conductive wire; and 13 second conductive wire.

DETAILED DESCRIPTION OF THE PRESENT INVENTION

Embodiment 1

A water mist nano gasification conversion device is provided. A main body of the water mist nano gasification conversion device comprises a shell and an atomization tube; the shell is provided with a supporting element for accommodating a conductive wire and supporting a conductive rod to isolate the conductive wire and water mist; the shell is of a hollow structure; an electronic high-voltage generator, a water supply tank, and an electronic water mist spraying device arranged in the water supply tank are arranged in the shell; the atomization tube is accommodated in the main body and is located above the water supply tank; an electric field region which uses a negative electric field to ionize and decompose water droplets and water mist sprayed by the electronic water mist spraying device is arranged in the atomization tube; the electric field region comprises at least one electric field generating component; the electric field generating component comprises a conductive ring and a conductive rod; one end of the conductive rod is fixed on the supporting element, and the other end is suspended and inserted into the conductive ring; a voltage output terminal of the electronic high-voltage generator is electrically connected with the conductive rod; and a grounding terminal of the electronic high-voltage generator is electrically connected with the conductive ring. During work with electricity, a negative electric field is formed between the conductive ring and the conductive rod.

As a preferred implementation mode of the present embodiment, the interior of the supporting element is of a hollow structure; the conductive rod is electrically connected with the output terminal of the electronic high-voltage generator through a first conductive wire; one end of the first conductive wire is connected with the conductive rod through a connection position between the conductive rod and the supporting element, and the other end passes through the hollow structure in the supporting element, extends out of the shell, and then is electrically connected with the voltage output terminal of the electronic high-voltage generator.

As a preferred implementation mode of the present embodiment, the atomization tube is an atomization tube made of insulation material As a preferred implementation mode of the present embodiment, the conductive ring is electrically connected with the grounding terminal of the electronic high-voltage generator through a second conductive wire; and a waterproof insulation element is arranged on the second conductive wire.

In the present embodiment, one end of the conductive rod 8 is connected with the supporting element 11, and is connected with the first conductive wire 12 inside the closed supporting element 11. The other end of the conductive rod 8 is suspended and inserted into the conductive ring 9. The structure is simple and easy to realize. The water mist can also be fully and uniformly ionized and decomposed to increase the efficiency.

Specifically, the interior of the supporting element 11 is of a hollow structure; the conductive rod 8 is electrically connected with the output terminal of the electronic high-voltage generator 5 through a first conductive wire 12; one end of the first conductive wire 12 is connected with the conductive rod 8 through a connection position between the conductive rod 8 and the supporting element 11, and the other end passes through the hollow structure in the supporting element 11, extends out of the shell, and then is electrically connected with the voltage output terminal of the electronic high-voltage generator 5. In the present embodiment, the atomization tube 2, the shell and an external environment form three spaces. The interior of the atomization tube 2 is a first space, the shell and the outer wall of the atomization tube 2 form a second space, and the exterior of the shell is a third space. After the first conductive wire 12 is connected with the conductive rod 8 and extends along the hollow structure of the supporting element 11, the first conductive wire 12 leads to the third space to isolate from the device in the shell, and then enters the shell in the position of the electronic high-voltage generator 5 in a way of a through hole to connect with the electronic high-voltage generator 5. The conductive ring 9 is electrically connected with the grounding terminal of the electronic high-voltage generator 5 through a second conductive wire 13. Since the second conductive wire 13 passes through the water supply tank 4, a waterproof insulation element is arranged on the second conductive wire 13 for waterproof isolation. In an embodiment, a groove for accommodating the first conductive wire is arranged on the outer wall of the shell to make the entire shell more beautiful. In the present embodiment, the conductive rod 8 is connected by the conductive wire, and the conductive wire is not in direct contact with the water mist, so as to avoid condensation of water vapor on the conductive wire, avoid forming a high-voltage discharge circuit by copper wires in the conductive rod and the conductive wire and avoid reducing the high voltage, so that the generation efficiency of nano water ions is not affected.

As a preferred implementation mode of the present embodiment, the water mist nano gasification conversion device further comprises a water inlet 3, and the water inlet 3 is communicated with the water supply tank 4.

As a preferred implementation mode of the present embodiment, the water mist nano gasification conversion device further comprises a fan 7 for blowing the water droplets and the water mist sprayed by the electronic water mist spraying device 6 into the atomization tube 2, so as to increase the conversion efficiency.

As a preferred implementation mode of the present embodiment, the negative high voltage outputted by the electronic high-voltage generator 5 is above 2 KV.

As a preferred implementation mode of the present embodiment, the electronic water mist spraying device 5 comprises an ultrasonic water mist spraying device or a pressure nozzle water mist spraying device.

As a preferred implementation mode of the present embodiment, the conductive ring 9 is made of a conductive sheet, a conductive fiber cloth, a metal sheet, or a plastic sheet coated with a conductive layer on an outer surface.

As a preferred implementation mode of the present embodiment, the conductive rod 8 is a metal rod, a conductive fiber rod, or a plastic rod coated with a conductive layer on an outer surface.

For the above device, the specific working process is as follows: the water supply tank 4 in the main body 1 is filled with water through the water inlet 3; a working power supply is turned on; at this time, the electronic high-voltage generator and the electronic water mist spraying device 6 work simultaneously; the water droplets and the water mist sprayed from the water in the water supply tank 4 by the electronic water mist spraying device 6 are blown into the atomization tube 2 by the fan 7, then enter the electric field region, and are ionized and decomposed through a high-voltage negative electric field formed between the conductive rod 8 and the conductive ring 9; After the water droplets and the water mist entering the atomization tube 2 are ionized and decomposed, nanoscale charged water mist can be obtained by ionization and decomposition, and sprayed out from the spraying port 10. That is, the device of the present invention is used to decompose water molecules sprayed by the electronic water mist spraying device 6 into ultra-fine nanoscale water molecules through micron-level ionization. For example: the diameter of the water molecules after original ultrasonic atomization is 5 micrometers, and the diameter of the water molecules with a diameter of 5 micrometers can be changed to 5 nanometers under the action of nano-ionization and decomposition, which is equivalent to changing one water molecule into 1000 smaller water molecules.

As a preferred implementation mode of the present embodiment, the negative high voltage outputted by the electronic high-voltage generator is above 2 KV, and a discharge electrode and a grounding electrode are provided.

As a preferred implementation mode of the present embodiment, the electronic water mist spraying device 6 comprises an ultrasonic water mist spraying device or a pressure nozzle water mist spraying device.

As a preferred implementation mode of the present embodiment, the atomization tube 2 is a water mist diversion device, and is a spraying tube having a square or circular cross section.

As a preferred implementation mode of the present embodiment, the spraying direction of the atomization tube 2 includes but not limited to four directions of up, down, left and right.

It is known from the above that the device of the present invention has the following advantages:

1. The device of the present invention can generate water mist with a nanoscale particle size, and solves the problem caused by the large particle size of the water mist. The water mist with the nanoscale particle size can freely diffuse into the air to keep clear indoor visibility. No water strain is generated on the surface of the object. Thus, the device does not cause moisture damage to wires, electrical appliances, instruments and equipment, books and furniture, and is suitable for aircrafts, submarines, museums, instrument and equipment rooms and other important places.

2. When the indoor air becomes dry, the moisture in the air will decrease, and the skin on the human surface will carries a large amount of static electricity (positive electrons), which will make people feel dry and itchy, and cause skin diseases. Since the device of the present invention can generate the nanoscale negatively charged water mist, the dirt with the positive electrons on the surface of the skin can be absorbed and removed. Meanwhile, the nanoscale water mist is easily absorbed by the skin to keep the skin hydrated and elastic. It can be seen that the device of the present invention can be widely used in humidifiers on the market to replace the humidifiers, and can also be widely used in various industries which need refined water mist, such as environmental protection, energy saving, automobiles, medical products, beauty products and other fields.

3. In the device of the present invention, the water mist with large diameter penetrates through the electric field region to generate the water mist with nanoscale particle size. The device has the functions of sterilization and disinfection. The water mist contains a large amount of negative ions. The negative ions achieve the effect of cleaning the air.

4. The conductive rod is connected by the conductive wire, and the conductive wire is not in direct contact with the water mist, so as to avoid condensation of water vapor on the conductive wire, avoid forming a high-voltage discharge circuit by copper wires in the conductive rod and the conductive wire and avoid reducing the high voltage, so that the generation efficiency of nano water ions is not affected.

The above specifically describes preferred embodiments of the present invention, but the present invention is not limited to the described embodiments. Those skilled in the art familiar with the art can make various equivalent variations or replacements without departing from the spirit of the present invention. These equivalent variations or replacements are included within the scope defined by the claims of the present application.

We claim:

1. A water mist nano gasification conversion device, wherein a main body of the water mist nano gasification conversion device comprises a shell and an atomization tube; the shell is provided with a supporting element for accommodating a conductive wire and supporting a conductive rod to isolate the conductive wire and water mist; the shell is of a hollow structure; an electronic high-voltage generator, a water supply tank, and an electronic water mist spraying device arranged in the water supply tank are arranged in the shell; the atomization tube is accommodated in the main body and is located above the water supply tank;

an electric field region which uses a negative electric field to ionize and decompose water droplets and water mist sprayed by the electronic water mist spraying device is arranged in the atomization tube; the electric field region comprises at least one electric field generating component; the electric field generating component comprises a conductive ring and a conductive rod; one end of the conductive rod is fixed on the supporting element, and the other end is suspended and inserted into the conductive ring; a voltage output terminal of the electronic high-voltage generator is electrically connected with the conductive rod; and the electronic high-voltage generator is electrically connected with the conductive ring.

2. The water mist nano gasification conversion device according to claim 1, wherein the interior of the supporting element is of a hollow structure; the conductive rod is electrically connected with the output terminal of the electronic high-voltage generator through a first conductive wire; one end of the first conductive wire is accommodated in the hollow structure of the supporting element, and is connected with the conductive rod inside the supporting element; and the other end of the first conductive wire extends out of the shell through the hollow structure in the supporting element, and then is electrically connected with the voltage output terminal of the electronic high-voltage generator.

3. The water mist nano gasification conversion device according to claim 2, wherein a groove for accommodating the first conductive wire is arranged on an outer wall of the shell.

4. The water mist nano gasification conversion device according to claim 2, wherein the conductive ring is electrically connected with the electronic high-voltage generator through a second conductive wire; and a waterproof insulation element is arranged on the second conductive wire.

5. The water mist nano gasification conversion device according to claim 1, wherein the atomization tube is an atomization tube made of insulation material.

6. The water mist nano gasification conversion device according to claim 1, further comprising a water inlet which is communicated with the water supply tank.

7. The water mist nano gasification conversion device according to claim 1, further comprising a fan for blowing the water droplets and the water mist sprayed by the electronic water mist spraying device into the atomization tube.

8. The water mist nano gasification conversion device according to claim 1, wherein the negative high voltage outputted by the electronic high-voltage generator is above 2 KV.

9. The water mist nano gasification conversion device according to claim 1, wherein the electronic water mist spraying device comprises an ultrasonic water mist spraying device or a pressure nozzle water mist spraying device.

10. The water mist nano gasification conversion device according to claim 1, wherein the conductive ring is made of a conductive sheet, a conductive fiber cloth, a metal sheet, or a plastic sheet coated with a conductive layer on an outer surface.

11. The water mist nano gasification conversion device according to claim 1, wherein the conductive rod is a metal rod, a conductive fiber rod, or a plastic rod coated with a conductive layer on an outer surface.

* * * * *